US010973099B1

(12) United States Patent
Peng

(10) Patent No.: US 10,973,099 B1
(45) Date of Patent: Apr. 6, 2021

(54) CARRY-SIGNAL CONTROLLED LED LIGHT WITH FAST DISCHARGE AND LED LIGHT STRING HAVING THE SAME

(71) Applicant: Semisilicon Technology Corp., New Taipei (TW)

(72) Inventor: Wen-Chi Peng, New Taipei (TW)

(73) Assignee: SEMISILICON TECHNOLOGY CORP., New Taipei (TW)

( * ) Notice: Subject to any disclaimer, the term of this patent is extended or adjusted under 35 U.S.C. 154(b) by 0 days.

(21) Appl. No.: 16/744,540

(22) Filed: Jan. 16, 2020

(51) Int. Cl.

| | |
|---|---|
| ***H05B 45/34*** | (2020.01) |
| ***H05B 45/44*** | (2020.01) |
| ***H05B 47/155*** | (2020.01) |
| ***H05B 45/10*** | (2020.01) |
| ***H05B 45/50*** | (2020.01) |
| ***H05B 45/00*** | (2020.01) |
| ***H05B 45/20*** | (2020.01) |

(52) U.S. Cl.
CPC ..... *H05B 45/34* (2020.01); *H05B 45/44* (2020.01); *H05B 47/155* (2020.01)

(58) Field of Classification Search
CPC ..... H05B 45/37; H05B 45/50; H05B 45/00; H05B 45/10; H05B 45/20; H05B 45/46; H05B 45/48; H05B 47/18; H05B 47/10; H05B 39/105; H05B 47/23
USPC ..... 315/291, 312, 70, 224, 294, 122
See application file for complete search history.

(56) References Cited

U.S. PATENT DOCUMENTS

| | | | | |
|---|---|---|---|---|
| 2014/0117964 | A1* | 5/2014 | Walters | H05B 45/38 323/299 |
| 2014/0217918 | A1* | 8/2014 | Knoedgen | H05B 45/382 315/224 |
| 2015/0312983 | A1* | 10/2015 | Hu | H05B 45/50 315/186 |
| 2016/0262229 | A1* | 9/2016 | Peng | H05B 47/185 |

FOREIGN PATENT DOCUMENTS

| | | |
|---|---|---|
| TW | M534491 U | 12/2016 |
| TW | 201715327 A | 5/2017 |
| TW | 201834506 A | 9/2018 |
| TW | I678945 B | 12/2019 |

OTHER PUBLICATIONS

Office Action dated Mar. 31, 2020 of the corresponding Taiwan patent application No. 108145360.

* cited by examiner

*Primary Examiner* — Wei (Victor) Y Chan
(74) *Attorney, Agent, or Firm* — Chun-Ming Shih; HDLS IPR Services

(57) ABSTRACT

A carry-signal controlled LED light with fast discharge includes at least one LED and a drive unit. The drive unit includes a signal detector, a fast discharge unit, a light control unit, and a capacitor. The signal detector receives the carry light signal and provides a discharging control signal according to the carry light signal. The fast discharge unit receives the discharging control signal and controls a voltage of the carry light signal to be fast lower than a low-level voltage. The light control unit drives the light behavior of the at least one LED according to light command content of the carry light signal. The capacitor receives a DC power source to be charged and provides the required work power to the LED light when the fast discharge unit fast discharges.

18 Claims, 13 Drawing Sheets

CARRY-SIGNAL CONTROLLED LED LIGHT WITH FAST DISCHARGE AND LED LIGHT STRING HAVING THE SAME

BACKGROUND

Technical Field

The present disclosure relates to an LED light and an LED light string, and more particularly to carry-signal controlled LED lights with fast discharge and an LED light string having the same.

Description of Related Art

The statements in this section merely provide background information related to the present disclosure and do not necessarily constitute prior art.

The statements in this section merely provide background information related to the present disclosure and do not necessarily constitute prior art.

Since light-emitting diode (LED) has the advantages of high luminous efficiency, low power consumption, long life span, fast response, high reliability, etc., LEDs have been widely used in lighting fixtures or decorative lighting, such as Christmas tree lighting, lighting effects of sport shoes, etc. by connecting light bars or light strings in series, parallel, or series-parallel.

Take the festive light for example. Basically, a complete LED lamp includes an LED light string having a plurality of LEDs and a drive unit for driving the LEDs. The drive unit is electrically connected to the LED light string, and controls the LEDs by a pixel control manner or a synchronous manner by providing the required power and the control signal having light data to the LEDs, thereby implementing various lighting output effects and changes of the LED lamp.

With the progress of the technology, the carrier manner can be utilized for the control signal having the light data to transmit the light signal through the power line. The functions of providing power and data transmission can be achieved by the same circuit structure to simplify the layout design, reduce the volume of the circuit, and benefit the design of the control circuit.

The drive unit mainly provides a light control signal with a high voltage level and a low voltage level to drive the LED light string. For driving the LED light string, if the LED light string includes more of the numbers of the LED lights in series, since the connection lines connecting the LEDs are thicker and longer, the parasitic capacitance of the LED light string increases so that the speed of the system processing the signals is not fast enough. Thus, the possibility of determining the light signal incorrectly increases. If effectively avoiding the LED light string interpreting/decoding the light control signal incorrectly is required, the speed of the light control signal at the high voltage and low voltage transition has to slow. However, this results that the number of the lights driven by the LED light string is less and/or the speed of changing lights/colors slows.

Please refer to FIG. 1, which shows a schematic waveform of a light control signal of an LED light string in the related art. FIG. 1 shows two waveforms of light control signals including a first waveform Cv1 and a second waveform Cv2. The abscissa indicates time t and the ordinate indicates input voltage Vin, and a low-level voltage Vlow and a reset voltage Vreset are labeled. The low-level voltage Vlow means a voltage for identifying a low level of the light control signal, and the reset voltage Vreset means a voltage for resetting the LED. Take the second waveform Cv2 for example, the second waveform Cv2 is the natural discharge of the light control signal. Therefore, the existing problem of the second waveform Cv2 is that when the parasitic capacitance of the circuit is too large, the discharge time is longer, resulting that when entering the next cycle, the second waveform Cv2 still cannot reach the low-level voltage Vlow so that the light control signal cannot be identified as the low level (namely, the light control signal is continuously determined as the high level voltage). At this condition, only increasing the width between two cycles (so the natural discharge is able to reach the low-level voltage Vlow) achieves the identification of the low-level voltage Vlow. However, such control manner is only suitable for less numbers of the LEDs in series in the LED light string (better control effect can just be achieved). In other words, since the complete light control signal cannot be achieved by rapidly discharging, such control manner cannot be suitable for more numbers of the lights (for example, over hundreds of the numbers of the lights) in series. That is, all of the numbers of the lights in series able to receive the complete light control signal cannot be ensured.

Accordingly, a rapid discharge circuit can be utilized to control the light control signal to rapidly reduce the voltage level of the light control signal, or the LED light string having lesser circuit total parasitic capacitance easily reduces the voltage level of the light control signal rapidly, such as the first waveform Cv1 shown in FIG. 1. However, when the light control signal rapidly reduces, the light control signal easily happens that: after the light control signal is lower than the identifiable low-level voltage Vlow (for example, at the time point t2), the light control signal still rapidly reduces so that the light control signal reaches the reset voltage Vreset (for example, at the time point t3) so that the circuit happens unnecessary reset failure, resulting in the abnormal determination and malfunction of the LED module.

The related art utilizes a set of signal voltage generation circuit on the control circuit to clamp the voltage so that the voltage does not reduce to be the reset voltage Vreset. However, eventually the circuits of such related art are complicated. Therefore, the inventor of the present disclosure would like to provide a simple circuit to solve the problem that how to design a carrier controlled LED light and the LED light string having the carrier controlled LED light for solving the voltage of the light control signal reaching the reset voltage due to too small parasitic capacitance which results in the abnormal determination and malfunction problems of the LED module.

SUMMARY

An object of the present disclosure is to provide a carry-signal controlled LED light with fast discharge to solve the problem that when the parasitic capacitance of the circuit wire is too large, the discharge time is longer, and the low level voltage cannot be reached so that it fails to identify the light control signal as a low-level signal.

In order to achieve the above-mentioned object, the carry-signal controlled LED light with fast discharge includes at least one LED and a drive unit. The drive unit is coupled to the at least one LED, and the drive unit receives a carry light signal and controls the at least one LED to light. The drive unit includes a signal detector, a fast discharge unit, a light control unit, and a capacitor. The signal detector receives the carry light signal and provides a discharge control signal according to the carry light signal. The fast discharge unit receives the discharge control signal and controls a voltage of the carry light signal to be fast lower than a low-level voltage. The light control unit drives the light behavior of the at least one LED according to light command content of the carry light signal. The capacitor receives a DC power source to be charged, and provides the required work power to the LED light when the fast discharge unit fast discharges.

In one embodiment, the carry-signal controlled LED light with fast discharge further includes a voltage clamp unit. The voltage clamp unit is coupled to the fast discharge unit, and clamps the voltage of the carry light signal to be greater than a reset voltage when the voltage of the carry light signal is less than the low-level voltage.

In one embodiment, the fast discharge unit is a resistor.

In one embodiment, the fast discharge unit is a series-connected structure composed of a resistor and a transistor.

In one embodiment, the fast discharge unit is a transistor.

In one embodiment, a resistance of the resistor is larger, the voltage of the carry light signal decreases faster.

In one embodiment, a resistance of the resistor is larger, the voltage of the carry light signal decreases faster.

In one embodiment, the transistor is a metal-oxide-semiconductor field-effect transistor.

In one embodiment, the signal detector generates a control signal for turning off analogy circuits in the LED light.

In one embodiment, the LED lamp is controlled by a pixel control manner or a synchronous control manner.

Accordingly, the voltage level of the light control signal can be fast reduced to be lower than the identifiable low level voltage, and by shortening the time of the identifiable low level voltage, the complete discharge of the light control signal can be achieved to the identifiable low level voltage so as to ensure that all the number of LEDs connected in series can receive the complete light control signal.

Another object of the present disclosure is to provide a carry-signal controlled LED light string to solve the problem that when the parasitic capacitance of the circuit wire is too large, the discharge time is longer, and the low level voltage cannot be reached so that it fails to identify the light control signal as a low-level signal.

In order to achieve the above-mentioned object, the carry-signal controlled LED light string includes a power line, a controller, and at least one LED light. The at least one LED light is coupled to the controller through the power line, and receives a DC working power and the carry light signal transmitted from the controller through the power line.

In one embodiment, the controller includes a rectifier unit, a switch, and a control unit. The rectifier unit is coupled to the power line and provides the DC working power. The switch is coupled to the power line and the at least one LED light. The control unit is coupled to the rectifier unit and the switch, wherein when the control unit turns on the switch, the DC working power forms a power supply loop for the LED light through the power line. When the control unit produces the carry light signal, the control unit continuously turns on and turns off the switch according to the light command content of the carry light signal so that the DC working power of the power line forms a plurality of a plurality of pulse waves to be combined into the carry light signal, and transmits the carry light signal to the LED light through the power line.

In one embodiment, the controller further includes a discharge circuit. The discharge circuit is coupled to the power line and the control unit. When the switch is turned off, the controller drives the discharge circuit to receive the DC working power and to start discharging the DC working power.

In one embodiment, the controller further includes a voltage adjust capacitor. The voltage adjust capacitor is coupled to the power line. When the switch is turned off, the voltage adjust capacitor provides the DC working power to the at least one LED light.

Accordingly, the voltage level of the light control signal can be fast reduced to be lower than the identifiable low level voltage, and by shortening the time of the identifiable low level voltage, the complete discharge of the light control signal can be achieved to the identifiable low level voltage so as to ensure that all the number of LEDs connected in series can receive the complete light control signal.

It is to be understood that both the foregoing general description and the following detailed description are exemplary, and are intended to provide further explanation of the present disclosure as claimed. Other advantages and features of the present disclosure will be apparent from the following description, drawings and claims.

BRIEF DESCRIPTION OF DRAWING

The present disclosure can be more fully understood by reading the following detailed description of the embodiment, with reference made to the accompanying drawing as follows.

DETAILED DESCRIPTION

Figure 1:
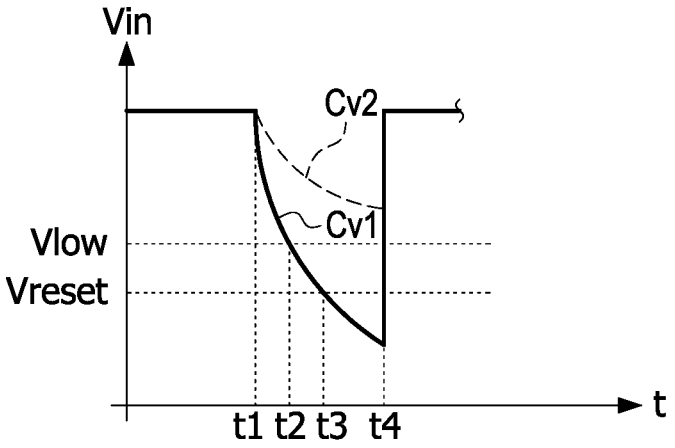
FIG.1 RELATED ART
FIG. 1 is a schematic waveform of a light control signal of an LED light string in the related art.

Reference will now be made to the drawing figures to describe the present disclosure in detail. It will be understood that the drawing figures and exemplified embodiments of present disclosure are not limited to the details thereof.

Figure 2A:
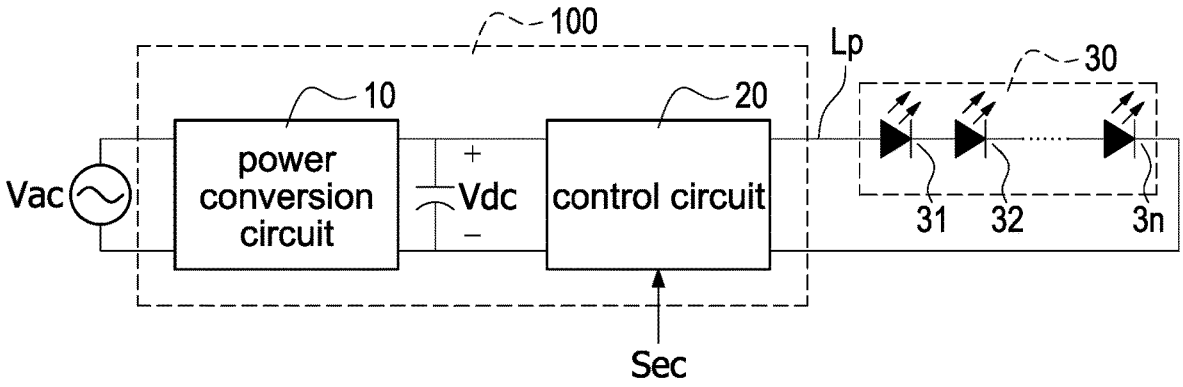
FIG. 2A is a block circuit diagram of a drive system of a carry-signal controlled LED light string according to a first embodiment of the present disclosure.

Please refer to FIG. 2A, which shows a block circuit diagram of a drive system of a carry-signal controlled LED light string according to a first embodiment of the present disclosure. The drive system of the first embodiment includes a power conversion circuit 10, a control circuit 20, and an LED (light-emitting diode) light string 30. The power conversion circuit 10 and the control circuit 20 may be integrated into a controller 100. Specifically, the controller 100 may be implemented by a physical circuit control box including the power conversion circuit 10 and the control circuit 20. The power conversion circuit 10 receives an AC power Vac and converts the AC power Vac into a DC power Vdc. The DC power Vdc is across an output capacitor (not labeled) connected at output terminals of the power conversion circuit 10.

The control circuit 20 receives the DC power Vdc to supply the required DC power for the control circuit 20 and the LED light string 30. The controller 100 is coupled to the AC power Vac and the LED light string 30 through a power line Lp. Broadly speaking, the power line Lp is not limited by the labeled indication in FIG. 2A. As long as the power line can be used as a line for transmitting AC power Vac or the DC power Vdc, it should belong to the power line Lp. For example, an electrical connection between the AC power Vac and the power conversion circuit 10, an electrical connection between the control circuit 20 and an anode terminal of the LED light string 30, or an electrical connection between the control circuit 20 and a cathode terminal of the LED light string 30. In one embodiment, the LED light string 30 includes a plurality of LED modules 31, 32, . . . , 3*n* (also refer to the LED light). The LED modules 31, 32, . . . , 3*n* are connected in series and electrically connected to the control circuit 20. In one embodiment, the LED light string 30 is a light string having data burning function, and therefore each of the LED modules 31, 32, . . . , 3*n* has own digital and analog circuits for burning light data and address data, the detailed description will be made as follows.

The control circuit 20 can receive external light control data Sec through a wired manner or a wireless manner as well as read internal light data stored inside the control circuit 20 so that the control circuit 20 can control each of the LED modules 31, 32, . . . , 3*n* of the LED light string 30 according to the content of the light control data Sec. For example, the user may operate a computer through the wired manner to transmit the light control data Sec to the control circuit 20 so that the control circuit 20 controls the LED modules 31, 32, . . . , 3*n* according to the light control data Sec. Alternatively, the user may operate a mobile phone or a wearable device through the wireless manner to transmit the light control data Sec to the control circuit 20 so that the control circuit 20 controls the LED modules 31, 32, . . . , 3*n* according to the light control data Sec. However, the present disclosure is not limited by the above-mentioned manners of transmitting the light control data Sec and the devices operated by the user.

Figure 2B:
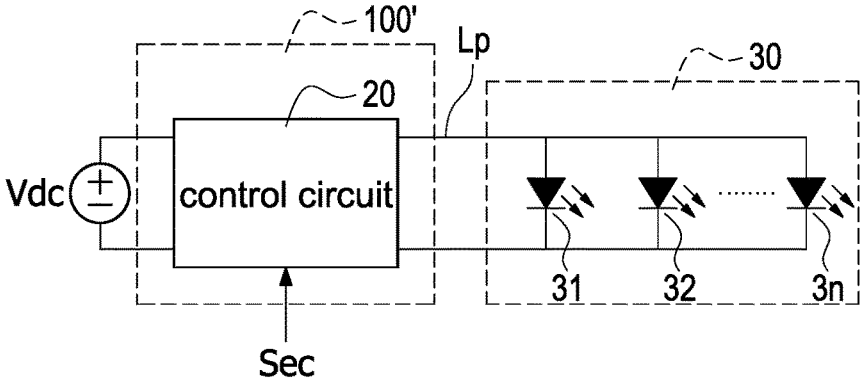
FIG. 2B is a block circuit diagram of the drive system of the carry-signal controlled LED light string according to a second embodiment of the present disclosure.

Please refer to FIG. 2B, which shows a block circuit diagram of the drive system of the carry-signal controlled LED light string according to a second embodiment of the present disclosure. The major difference between the second embodiment and the first embodiment shown in FIG. 2A is that the LED modules 31, 32, . . . , 3*n* of the LED light string 30 are electrically connected in parallel and electrically connected to the control circuit 20 in the former (i.e., the second embodiment). Therefore, the control circuit 20 and the LED modules 31, 32, . . . , 3*n* are directly supplied power by a DC power Vdc for example but not limited to a battery unit. In comparison with the first embodiment shown in FIG. 2A, the absence of the power conversion circuit 10 is to omit converting the AC power Vac into the DC power Vdc. Similarly, the LED light string 30 is a light string having data burning function, and therefore each of the LED modules 31, 32, . . . , 3*n* has own digital and analog circuits for burning light data and address data, the detailed description will be made as follows.

Figure 3A:
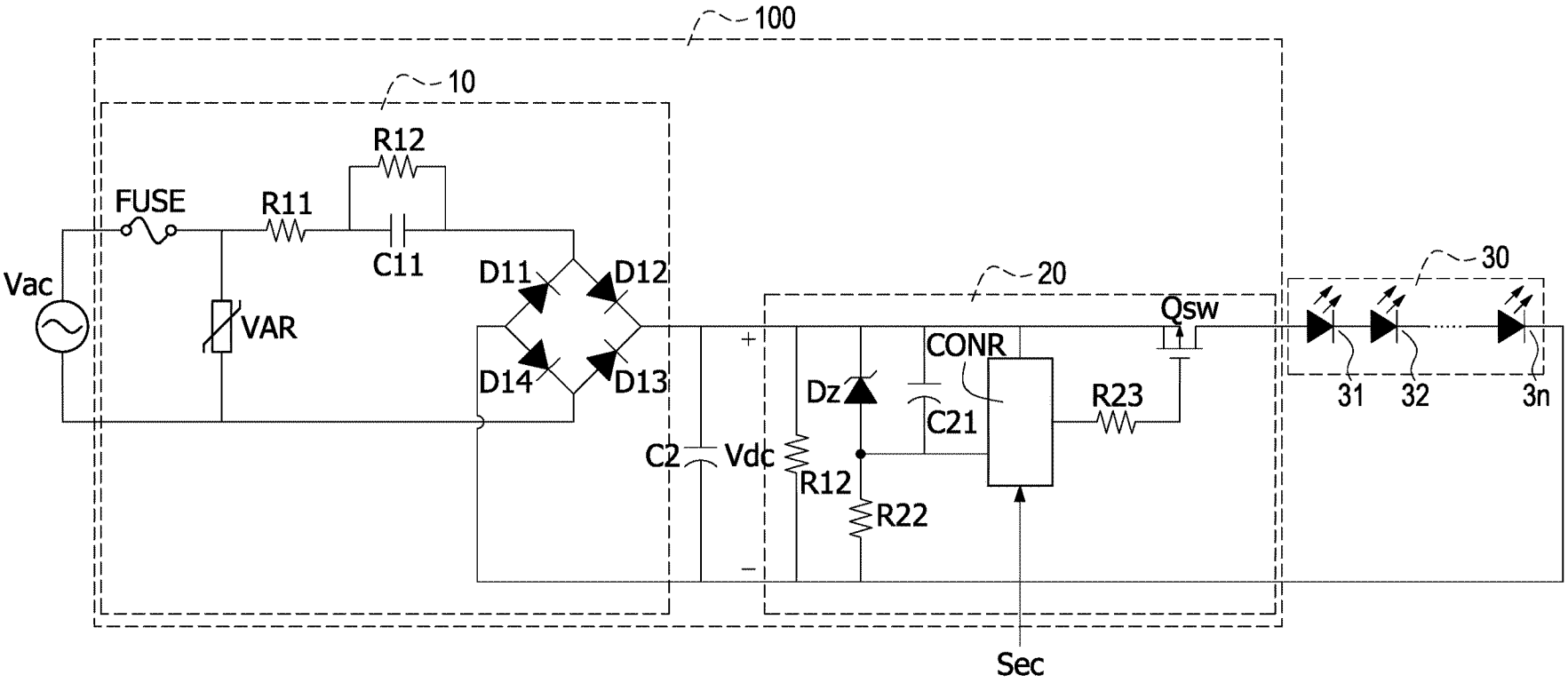
FIG. 3A is a detailed circuit diagram of a power conversion circuit and a control circuit according to a first embodiment in FIG. 2A.
Figure 3B:
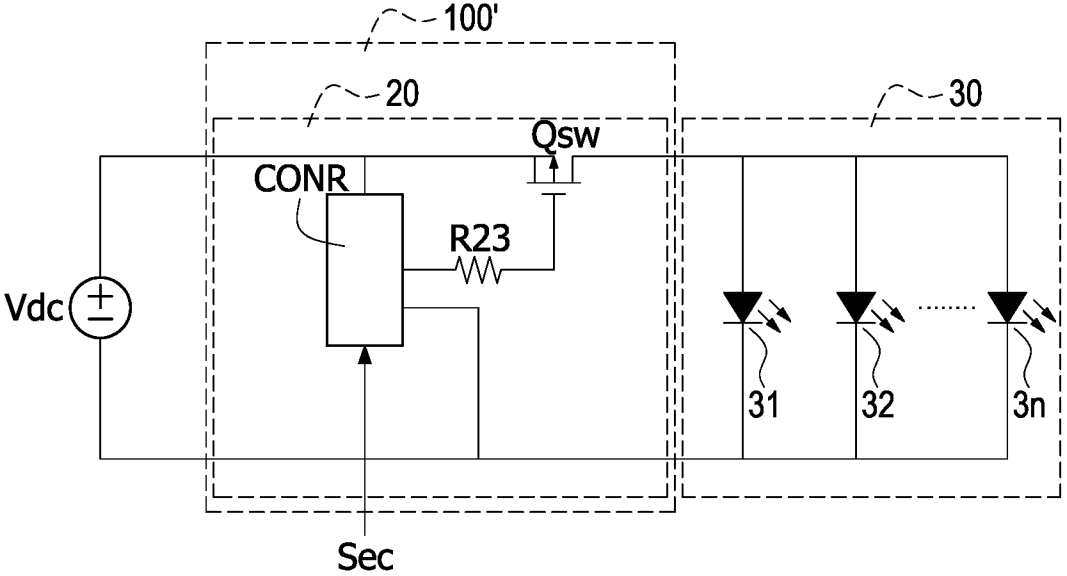
FIG. 3B is a detailed circuit diagram of the power conversion circuit and the control circuit in FIG. 2B.

Please refer to FIG. 3A and FIG. 3B, which show detailed circuit diagrams of a power conversion circuit and a control circuit in FIG. 2A and FIG. 2B, respectively. The power conversion circuit 10 includes a fuse FUSE, a varistor VAR, an input resistor R10, an input capacitor C11 connected to the input resistor R10 in parallel, and a full-bridge rectifier composed of a plurality of diodes D11-D14. The fuse FUSE provides an over-current protection for the power conversion circuit 10, and the varistor VAR provides an over-voltage protection for the power conversion circuit 10. The input resistor R10 and the input capacitor C11 are coupled between the fuse FUSE, the varistor VAR, and the full-bridge rectifier, and excess energy can be absorbed by the input capacitor C11 so as to adjust a total voltage for supplying the LED light string 30. The AC power Vac is rectified into the DC power Vdc by the full-bridge rectifier, and the DC power Vdc is across an output capacitor C2 connected at output terminals of the power conversion circuit 10.

The control circuit 20 includes a control unit CONR, an output control switch Qsw, and a work voltage generation circuit. The control unit CONR is coupled to the output control switch Qsw and the work voltage generation circuit. The output control switch Qsw receives the DC power Vdc and the output control switch Qsw is turned on or turned off by the control unit CONR to connect or disconnect the DC power Vdc to the LED light string 30. In one embodiment, the output control switch Qsw is coupled to an anode terminal of the LED light string 30, and the output control switch Qsw is a p-channel MOSFET and coupled to the control unit CONR through a resistor R23. In another embodiment, the output control switch Qsw may be coupled to a cathode terminal of the LED light string 30, and the output control switch Qsw is an n-channel MOSFET and coupled to the control unit CONR through the resistor R23, and therefore the equivalent characteristics of the circuit can be achieved.

In one embodiment, the work voltage generation circuit includes a resistor R22, a capacitor C21, and a Zener diode Dz. The capacitor C21 is connected in parallel to the Zener diode Dz, and then connected to the resistor R22. The Zener diode Dz receives the DC power Vdc through the resistor R22, and clamps the DC power Vdc in a fixed voltage value for providing the required work voltage to the control unit CONR. The present disclosure is not limited by the architecture of the work voltage generation circuit shown in FIG. 3A, that is, as long as the circuit architecture capable of achieving the function of generating the working voltage should be included in the scope of the present disclosure.

Figure 3C:
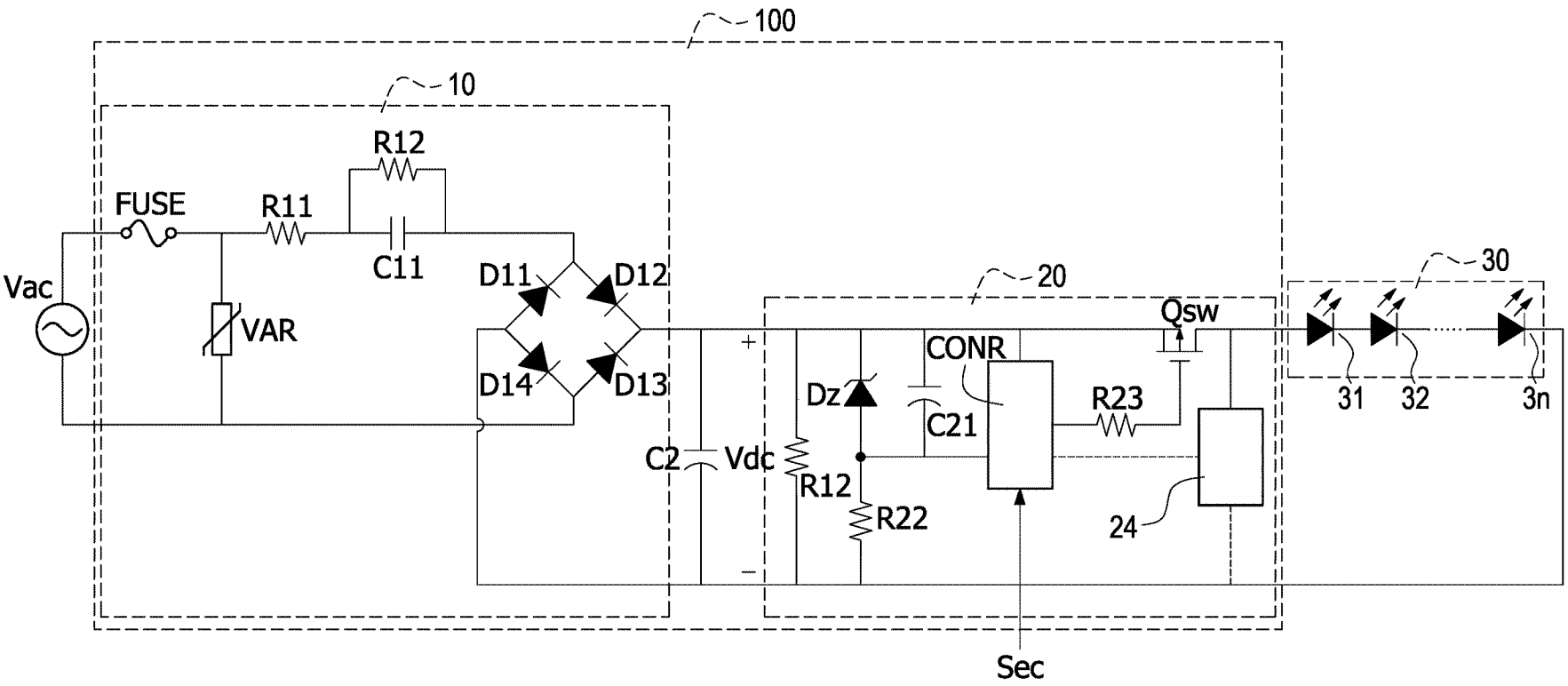
FIG. 3C is a detailed circuit diagram of the power conversion circuit and the control circuit according to a second embodiment in FIG. 2A.

Please refer to FIG. 3C, which shows a detailed circuit diagram of the power conversion circuit and the control circuit according to a second embodiment in FIG. 2A. In comparison with FIG. 3A, the control circuit 20 further includes a voltage adjust unit 24. The voltage adjust unit 24 can be a fast discharge circuit for fast discharging the DC working power to supply the LED light string 30. Alternatively, the voltage adjust unit 24 is a voltage adjust capacitor for slowly discharging the DC working power to supply the LED light string 30.

If the voltage adjust unit 24 is the voltage adjust capacitor, the voltage adjust unit 24 is coupled in parallel to the LED light string 30 for slowly discharging the DC working power to supply the LED light string 30 according to the capacitance value of the voltage adjust capacitor.

If the voltage adjust unit 24 is the fast discharging circuit, the voltage adjust unit 24 is coupled to the output control switch Qsw, the LED light string 30, and the control unit CONR, and the voltage adjust unit 24 is controlled by the control unit CONR. When the control unit CONR turns off the output control switch Qsw, the control unit CONR controls an output voltage, i.e., a voltage outputted from the LED light string 30 by a discharging manner, or controls the fast discharging circuit (i.e., the voltage adjust unit 24), or controls a fast discharging circuit (not shown) inside each of the LED modules 31, 32, . . . , 3*n* so as to fast reduce a voltage of the DC working power outputted to the LED light string 30. The control unit CONR turns on the output control switch Qsw according to the predetermined time to restore (increase) the output voltage outputted to the LED light string 30, and produces a carry light signal according to the received light control data Sec so that the LED light string 30 operates in an illumination mode according to the carry light signal.

On the contrary, if no carry light signal is transmitted to the LED light string 30, the control unit CONR turns on the output control switch Qsw so that the DC power Vdc (i.e., the DC working electricity) supplies power to the LED light string 30 through the output control switch Qsw. Accordingly, as long as the output control switch Qsw is turned off or turned on, the carry light signal and the supplying power can be both transmitted to the LED light string 30 under the same circuit architecture.

Figure 4A:
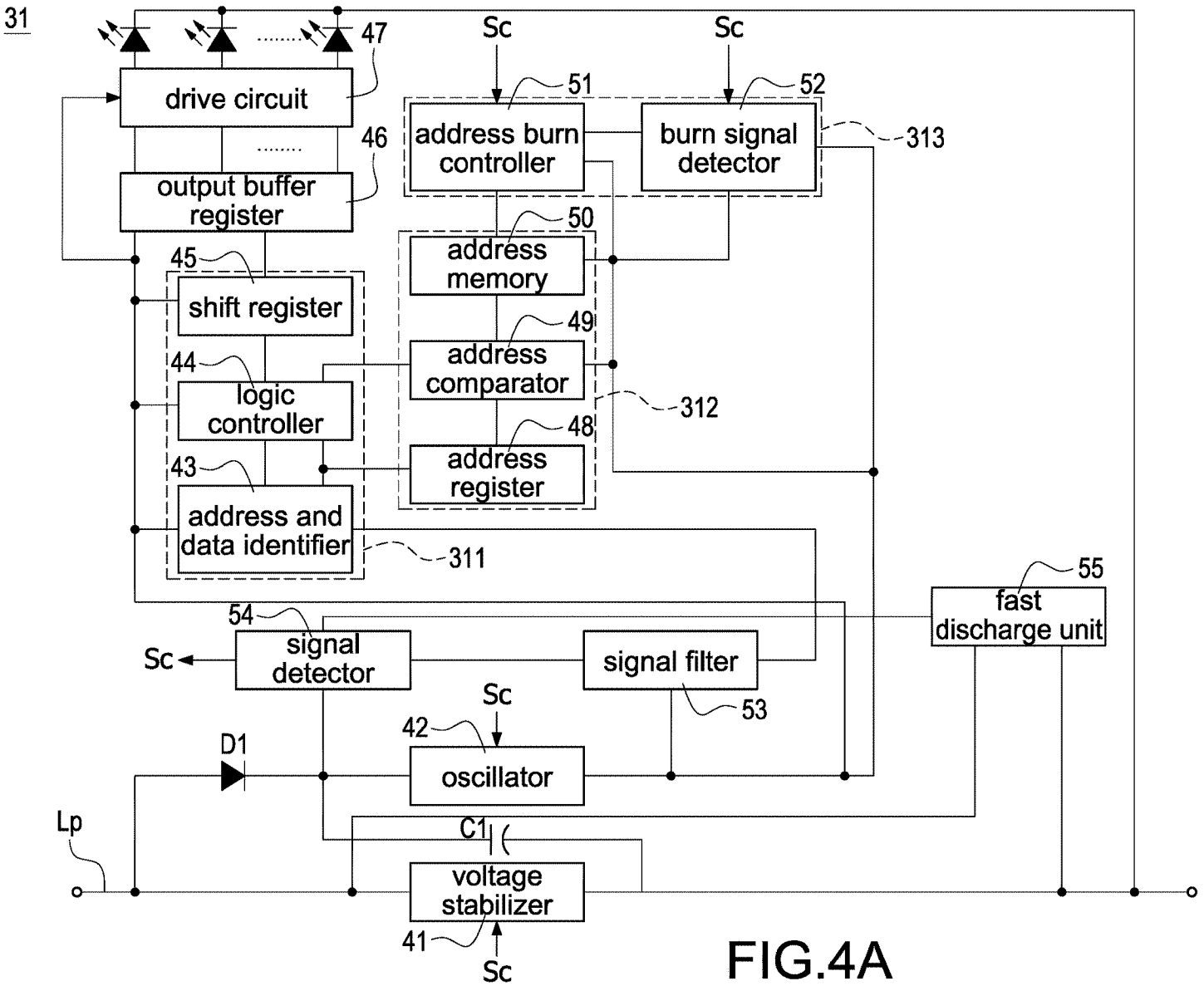
FIG. 4A is a block circuit diagram of an LED module according to a first embodiment of the present disclosure.

Please refer to FIG. 4A, which shows a block circuit diagram of an LED module according to a first embodiment of the present disclosure. Specifically, in the first embodiment, the LED module is controlled by a pixel control manner. As mentioned above, since the LED light string 30 is a light string which has burn functions, each of the LED modules 31, 32 . . . 3*n* respectively comprises digital and analog circuits which burn and process the light data and the address data, for example, a light control unit 311 which is in charge of light control, an address signal process unit 312 which is in charge of address signal processing, and an address burn unit 313 which is in charge of burning the address. Taking the LED module 31 with the burn function shown in FIG. 4A as an example, the LED module 31 (namely, the LED light) comprises a voltage stabilizer 41 (namely, voltage regulator), an oscillator 42, an address and data identifier 43 (namely, address and data recognizer), a logic controller 44, a shift register 45, an output buffer register 46, a drive circuit 47, an address register 48, an address comparator 49, an address memory 50, an address burn controller 51, a burn signal detector 52, a signal filter 53, a signal detector 54, a fast discharge unit 55, a first diode D1, and a first capacitor C1.

The light control unit 311 includes the above-mentioned address and data identifier 43, logic controller 44, and shift register 45. The light control unit 311 drives the LEDs according to a light command content of the carry light signal. In particular, the light command content is specific identified encoded content corresponding to luminous behaviors of the LEDs, such as color change, light on/off manner, light on/off frequency, etc. The address signal process unit 312 includes the above-mentioned address register 48, address comparator 49, and address memory 50. The address burn unit 313 includes the above-mentioned address burn controller 51 and burn signal detector 52.

Since the LED module 31 shown in FIG. 4A is applied to the in-series connection shown in FIG. 2A and FIG. 3A, the voltage stabilizer 41 is necessary for voltage regulation and voltage stabilization. Since the LED module 31 shown in FIG. 4A operates by a pixel control manner, the LED module 31 includes the address signal process unit 312 and the address burn unit 313 for processing (including determining, memorizing, burning, etc.) address data. That is, the address register 48, the address comparator 49, the address memory 50, the address burn controller 51, the burn signal detector 52 are involved. In other words, if the LED module 31 operates by a synchronous control, the address signal process unit 312 and the address burn unit 313 can be omitted, that is, only the light control unit 311 with processing light data is necessary.

The voltage stabilizer 41 receives an input voltage and regulates and controls the received input voltage to provide a stable output voltage. The oscillator 42 produces a periodic clock signal as a time reference for the light control unit 311, the address signal process unit 312, and the address burn unit 313 normally and orderly operating. When the oscillator 42 enters the sleep mode to stop oscillating, the light control unit 311, the address signal process unit 312, and the address burn unit 313 are controlled to enter the sleep mode.

The address and data identifier 43 is coupled to the oscillator 42. The logic controller 44 is coupled to the address and data identifier 43. The shift register 45 is coupled to the logic controller 44. The output buffer register 46 is coupled to the shift register 45 and the drive circuit 47. The drive circuit 47 is coupled to a plurality of LEDs.

The address register 48 is coupled to the logic controller 44. The address comparator 49 is coupled to the logic controller 44 and the address register 48. The address memory 50 is coupled to the address comparator 49. The address burn controller 51 is coupled to the address memory 50. The burn signal detector 52 is coupled to the address memory 50 and the address burn controller 51.

The carry light signal Vd produced from the control circuit 20 is transmitted to the LED module 31, and then is filtered by the signal filter 53, and then is provided to the address and data identifier 43 for identifying. The address and data identifier 43 identifies out the address data and the light data of the carry light signal Vd, and then the address and data identifier 43 transmits the address data and the light data to the logic controller 44. The logic controller 44 transmits the address data to the address register 48. However, it is not limited to the present disclosure. The address data identified from the address and data identifier 43 may be transmitted to the address register 48 by the address and data identifier 43.

The address comparator 49 receives the address data of the address register 48, and also receives the local address data stored in the address memory 50. Afterward, the address data are compared with the local address data. If the address data are identical with the local address data, it means that the light data received by the logic controller 44 are the light control data of the LED module 31. At this condition, the address comparator 49 notifies the logic controller 44 to transmit the light data to the drive circuit 47 through the shift register 45 and the output buffer register 46 for driving the LEDs. On the contrary, if the address data are not identical with the local address data, it means that the light data received by the logic controller 44 are not the light control data of the LED module 31, but the light control data of any one of the LED modules 32, . . . , 3*n*.

When the burn signal detector 52 detects a burn start signal, the burn signal detector 52 notifies the address burn controller 51. At this condition, the address burn controller 51 starts to receive burn address data and then burns the burn address data into the address memory 50 so that the local address data are stored in the address memory 50.

As mentioned above, the output control switch Qsw receives the DC power Vdc. When the output control switch Qsw is turned on, the DC power Vdc is transmitted to the LED module 31. As shown in FIG. 4A, the DC power Vdc is used to charge the first capacitor C1 through a path composed of a first diode D1 and a first capacitor C1. When the output control switch Qsw is turned off, the DC power Vdc fails to be transmitted to the LED module 31, the first capacitor C1 is used to supply the required power for internal circuits of the LED module 31. Also, according to the energy storage capacity of the first capacitor C1 (i.e., the size of the first capacitor C1), the condition of the power required for supplying the internal circuits can be determined. When necessary (i.e., the first capacitor C1 is not enough to provide the power required for the internal circuits), the control signal Sc outputted from the signal detector 54 can control analog circuits with relatively high power consumption to enter a sleep mode or an eco mode so as to increase the performance of the LED module 31.

Another path of the DC power Vdc is formed by the first diode D1 and the signal detector 54. The signal detector 54 controls the fast discharge unit 55 according to the detected DC power Vdc so that the voltage level of the light control signal is fast reduced to be lower than the identifiable low level voltage. By shortening the time of the identifiable low level voltage, the complete discharge of the light control signal can be achieved to the identifiable low level voltage so as to ensure that all the number of LEDs connected in series (especially the string with more LEDs in series) can receive the complete light control signal.

Furthermore, the voltage stabilizer 41 is used for clamping voltage to prevent the voltage level from touching the reset voltage Vreset (as shown in FIG. 1) when the voltage level of the light control signal decreases fast, thereby avoiding unnecessary reset malfunction of the circuit, resulting in abnormal determination and malfunction of the LED module 31.

Figure 4B:
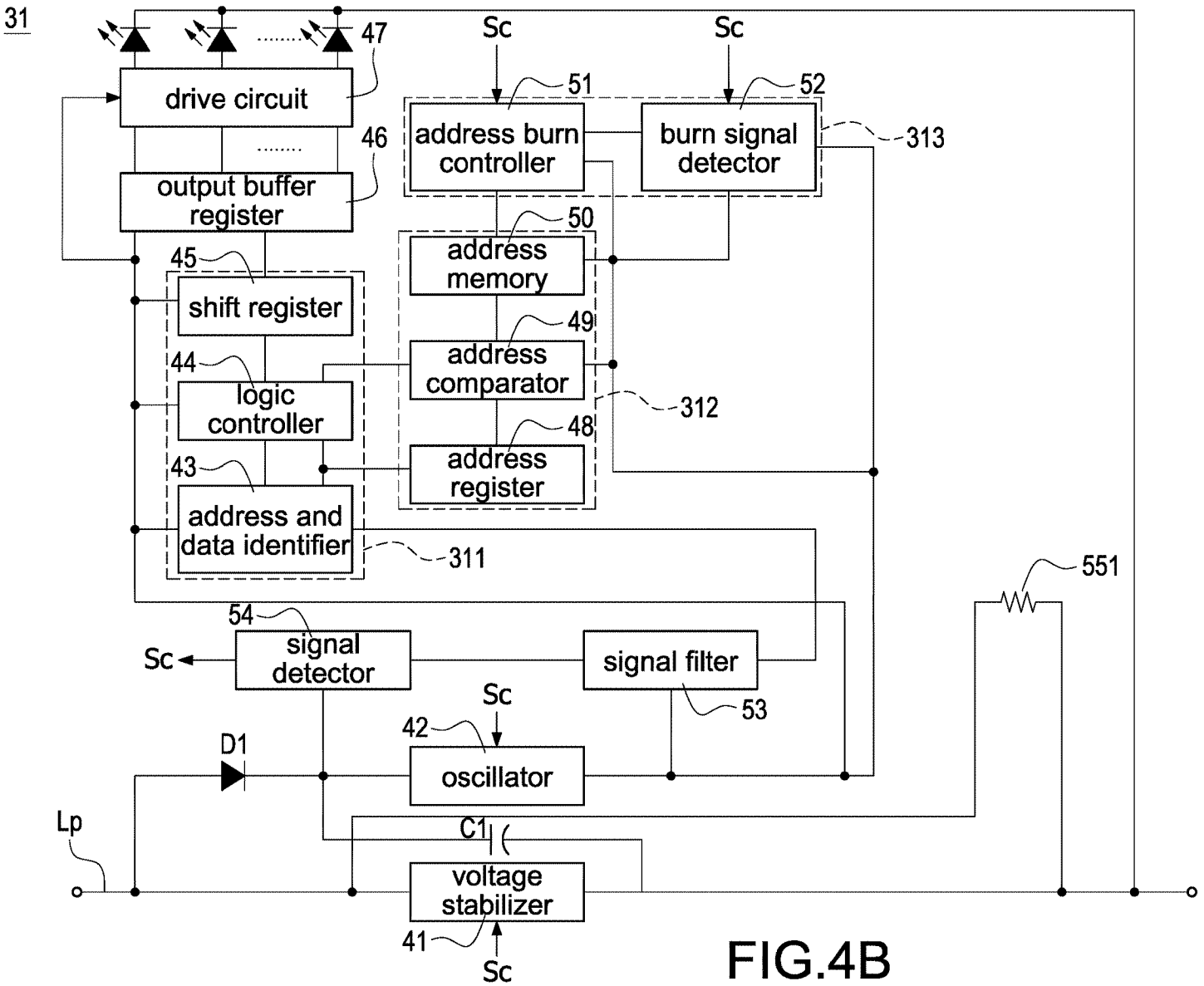
FIG. 4B to FIG. 4D are block circuit diagrams of three specific circuits of the LED module according to the first embodiment of the present disclosure.
Figure 4C:
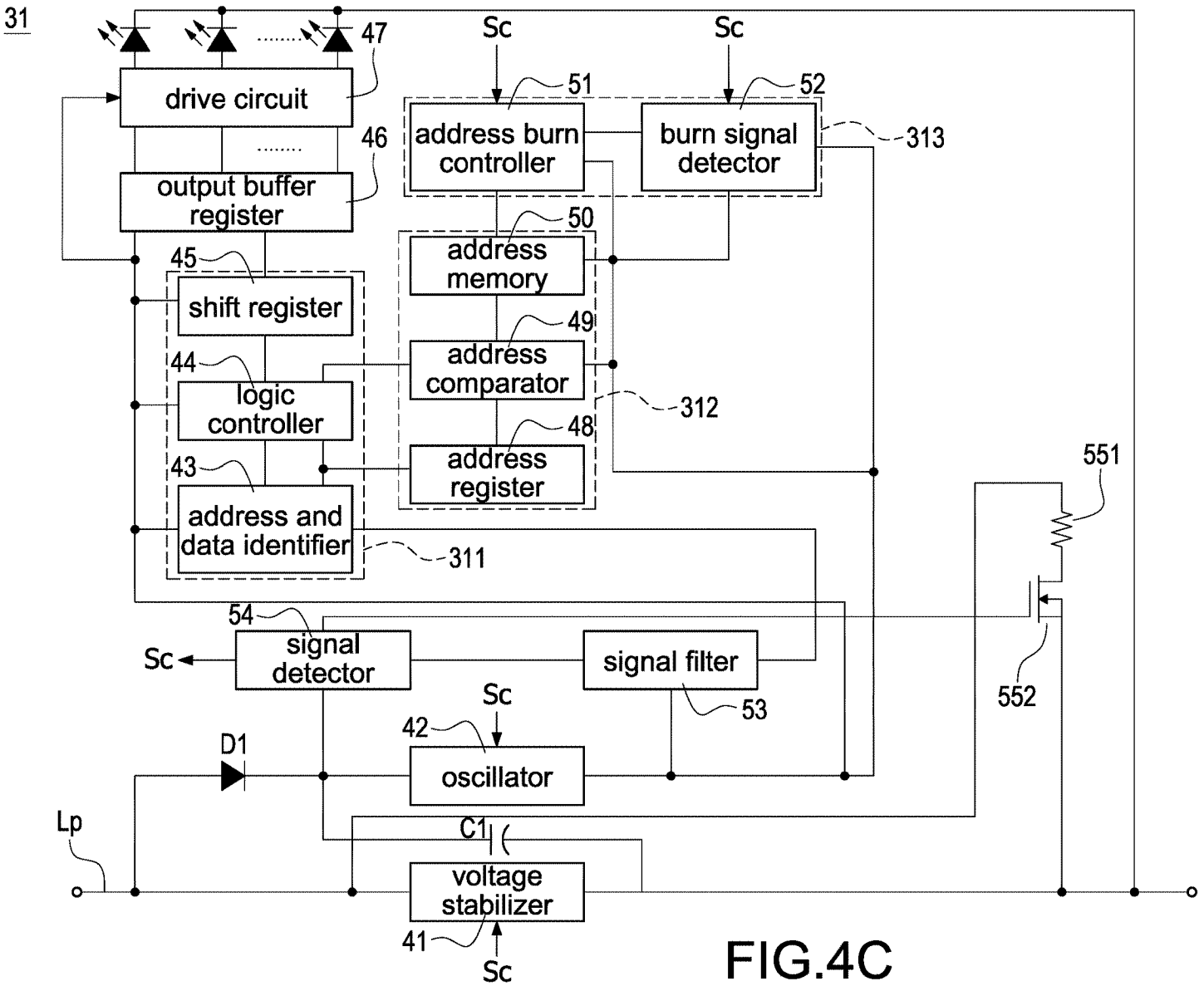
Figure 4D:
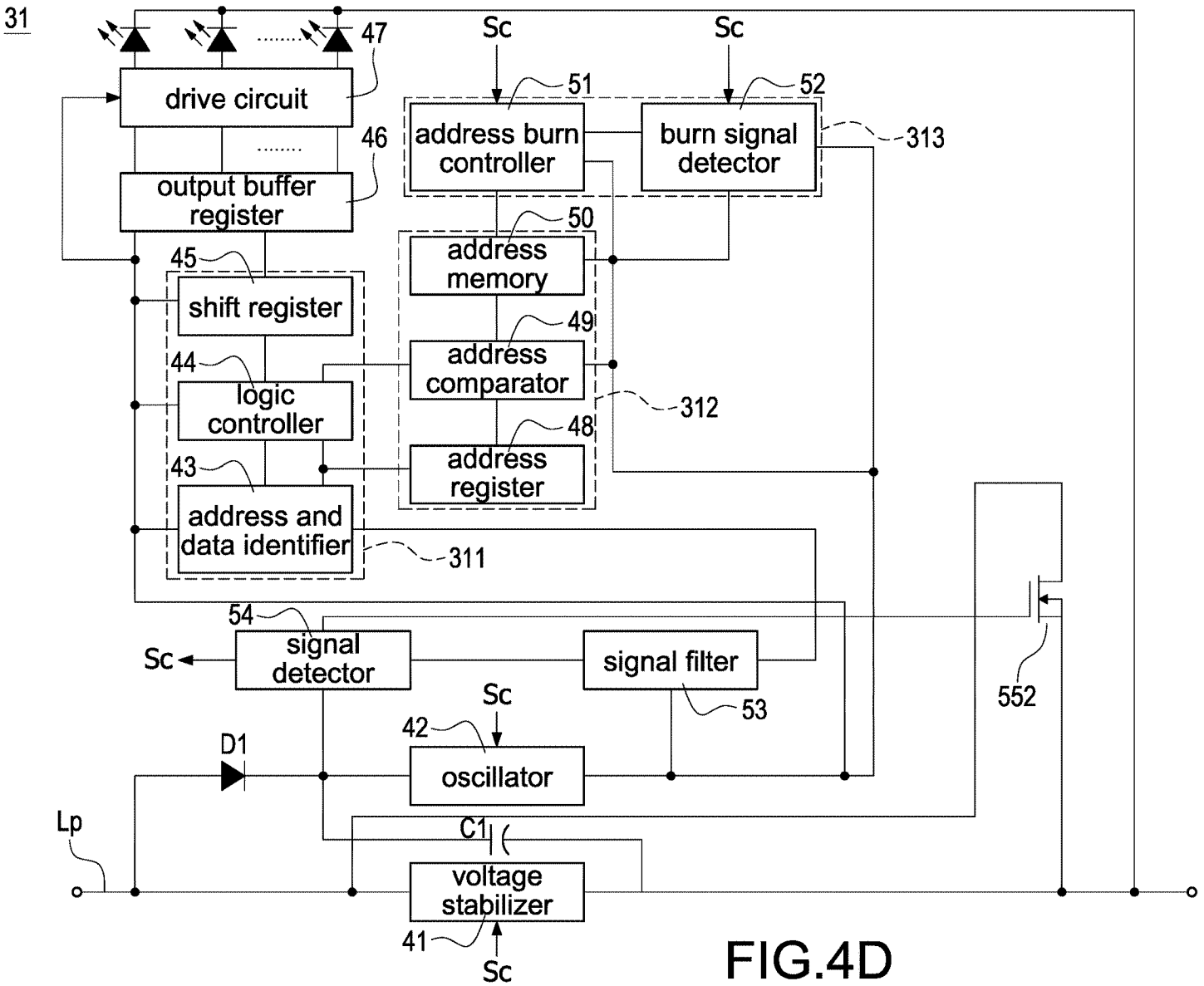

Please refer to FIG. 4B to FIG. 4D, which show block circuit diagrams of three specific circuits of the LED module according to the first embodiment of the present disclosure. In FIG. 4B, the fast discharge unit 55 is implemented by a resistor 551. Two ends of the resistor 551 are coupled to two ends of the voltage stabilizer 41, and the power consumption of the resistor 551 can reduce the voltage level of the light control signal. Specifically, when the resistance of the resistor 551 is larger, the voltage level decreases faster; on the contrary, when the resistance of the resistor 551 is smaller, the voltage level decreases slowly. Therefore, the effect of fast discharge can be achieved.

In FIG. 4C, the fast discharge unit 55 is implemented by a series-connected structure composed of a resistor 551 and a transistor 552 coupled in series to the resistor 551. Two ends of the series-connected structure are coupled at two ends of the voltage stabilizer 41, and a gate of the transistor 552 is coupled to the signal detector 54. Similarly, the signal detector 54 controls turning on the transistor 552 so that a turn-on resistance Rds(on) of the MOSFET is connected in series to the resistor 551 to reduce the voltage level of the light control signal, thereby implementing the fast discharge. Specifically, when the resistance of the resistor 551 is larger, the voltage level decreases faster; on the contrary, when the resistance of the resistor 551 is smaller, the voltage level decreases slowly. Similarly, when the turn-on resistance Rds(on) of the transistor 552 is larger, the voltage level decreases faster; on the contrary, when the turn-on resistance Rds(on) of the transistor 552 is smaller, the voltage level decreases slowly.

In FIG. 4D, the fast discharge unit 55 may be implemented by a transistor 552, for example but not limited to a metal-oxide-semiconductor field-effect transistor (MOSFET). Take the MOSFET as the transistor 552 as an example, a source and a drain of the MOSFET are coupled to two ends of the voltage stabilizer 41, and a gate of the MOSFET is coupled to the signal detector 54. The signal detector 54 controls turning on the transistor 552 so that the turn-on resistance Rds(on) to reduce the voltage level of the light control signal, thereby implementing the fast discharge.

Figure 5A:
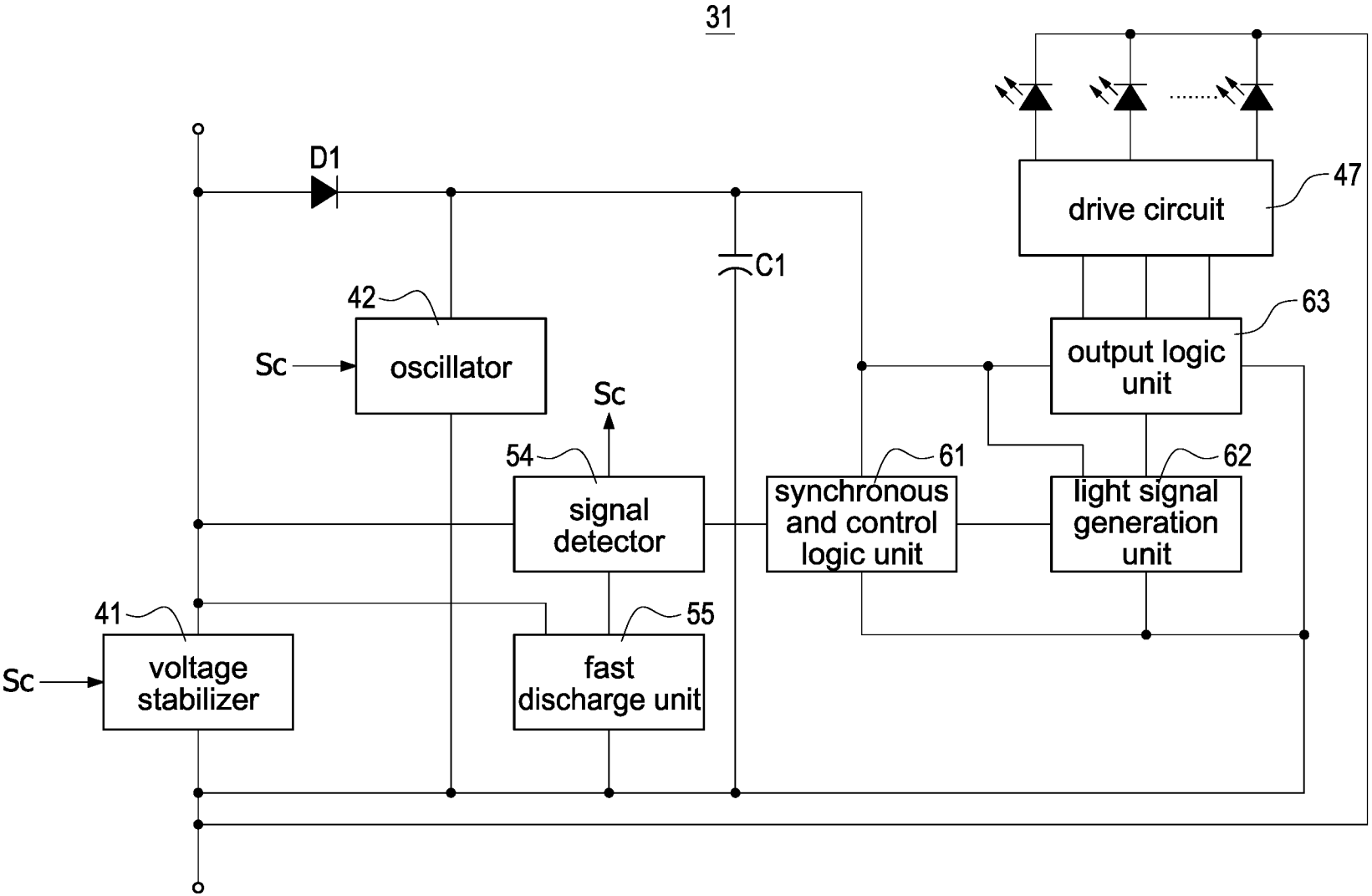
FIG. 5A is a block circuit diagram of the LED module according to a second embodiment of the present disclosure.

Please refer to FIG. 5A, which shows a block circuit diagram of the LED module according to a second embodiment of the present disclosure. Specifically, the LED module 31 is controlled by a synchronous control manner. The LED module 31 having the synchronous signal includes a voltage stabilizer 41, an oscillator 42, a signal detector 54, a fast discharge unit 55, a synchronous and control logic unit 61, a light signal generation unit 62, an output logic unit 63, a drive circuit 47, a first diode D1, and a first capacitor C1.

The synchronous and control logic unit 61 transmits a synchronous clock signal to the light signal generation unit 62. The light signal generation unit 62 transmits a light control signal to the output logic unit 63. According to the light control signal, the output logic unit 63 controls the drive circuit 47 to drive LEDs.

As mentioned above, the output control switch Qsw receives the DC power Vdc. When the output control switch Qsw is turned on, the DC power Vdc is transmitted to the LED module 31. As shown in FIG. 5A, the DC power Vdc is used to charge the first capacitor C1 through a path composed of the first diode D1 and the first capacitor C1. When the output control switch Qsw is turned off and the DC power Vdc fails to be transmitted to the LED module 31, the first capacitor C1 is used to supply the required power for internal circuits of the LED module 31. Also, according to the energy storage capacity of the first capacitor C1 (i.e., the size of the first capacitor C1), the condition of the power required for supplying the internal circuits can be determined. When necessary (i.e., the first capacitor C1 is not enough to provide the power required for the internal circuits), the control signal Sc outputted from the signal detector 54 can control analog circuits with relatively high power consumption to enter a sleep mode or an eco mode so as to increase the performance of the LED module 31.

Another path of the DC power Vdc is formed by the signal detector 54. The signal detector 54 controls the fast discharge unit 55 according to the detected DC power Vdc so that the voltage level of the light control signal is fast reduced to be lower than the identifiable low level voltage. By shortening the time of the identifiable low level voltage, the complete discharge of the light control signal can be achieved to the identifiable low level voltage so as to ensure that all the number of LEDs connected in series (especially the string with more LEDs in series) can receive the complete light control signal.

Furthermore, the voltage stabilizer 41 is used for clamping voltage to prevent the voltage level from touching the reset voltage Vreset (as shown in FIG. 1) when the voltage level of the light control signal decreases fast, thereby avoiding unnecessary reset malfunction of the circuit, resulting in abnormal determination and malfunction of the LED module 31.

Figure 5B:
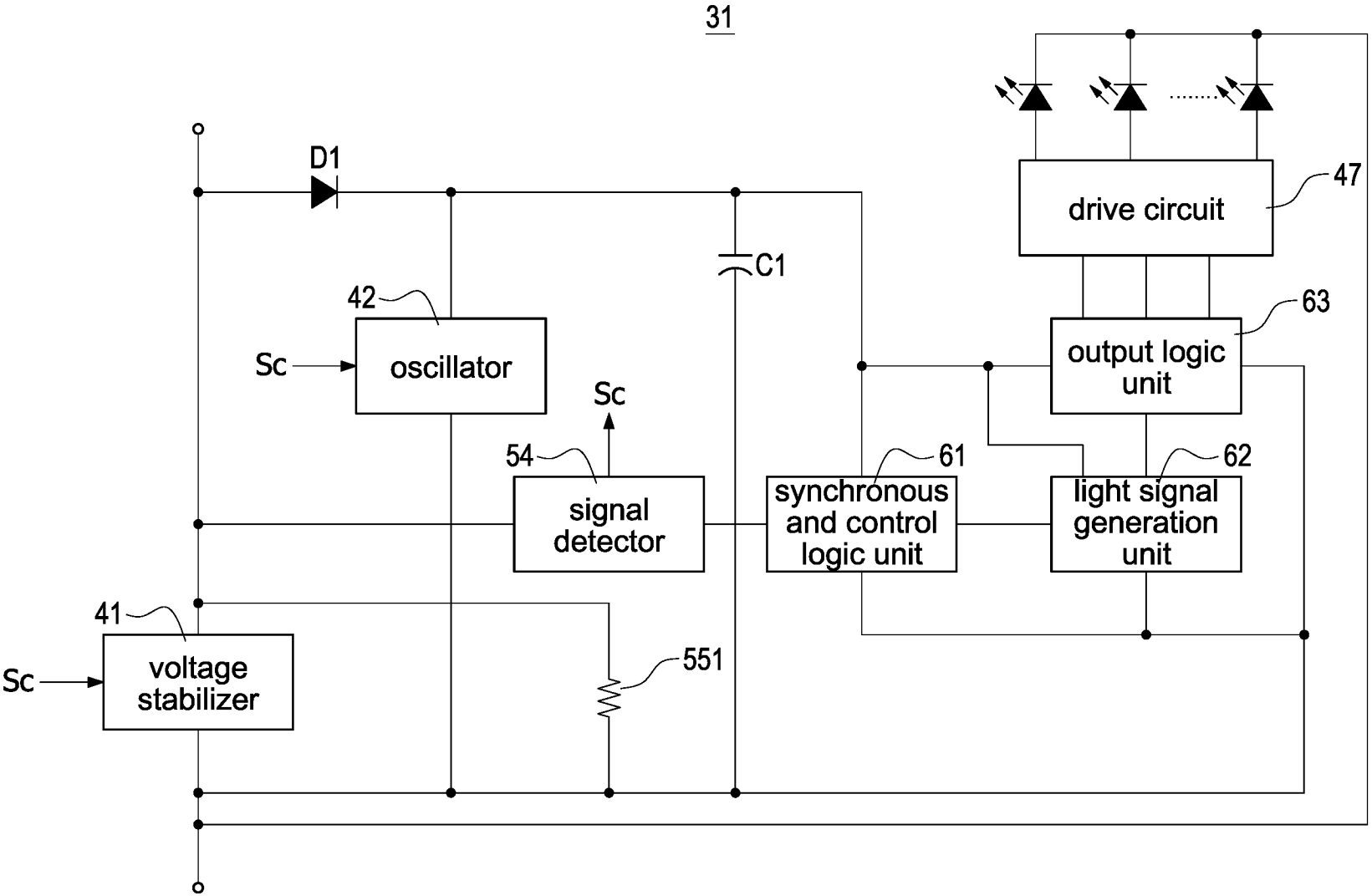
FIG. 5B to FIG. 5D are block circuit diagrams of three specific circuits of the LED module according to the second embodiment of the present disclosure.
Figure 5C:
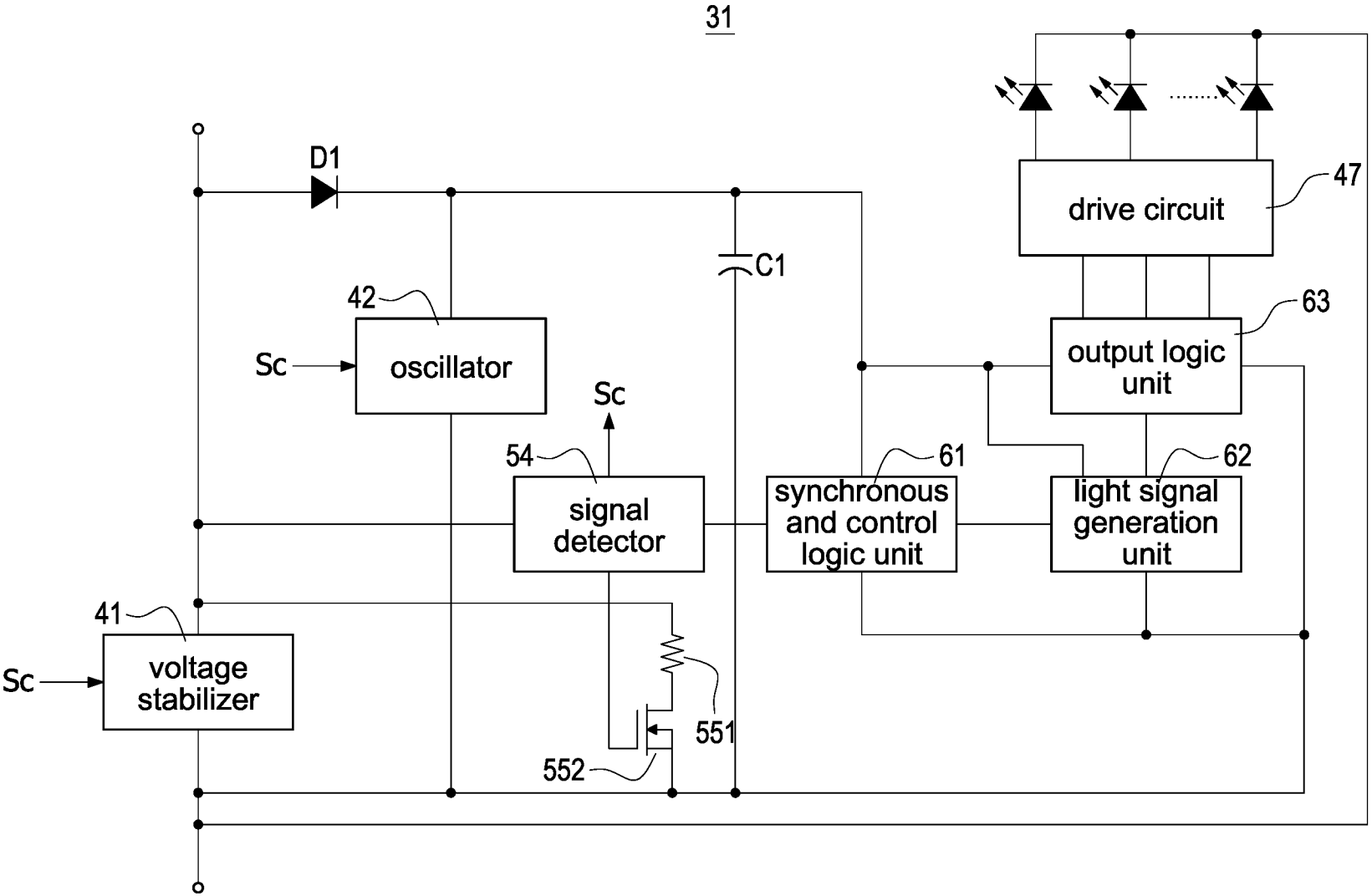
Figure 5D:
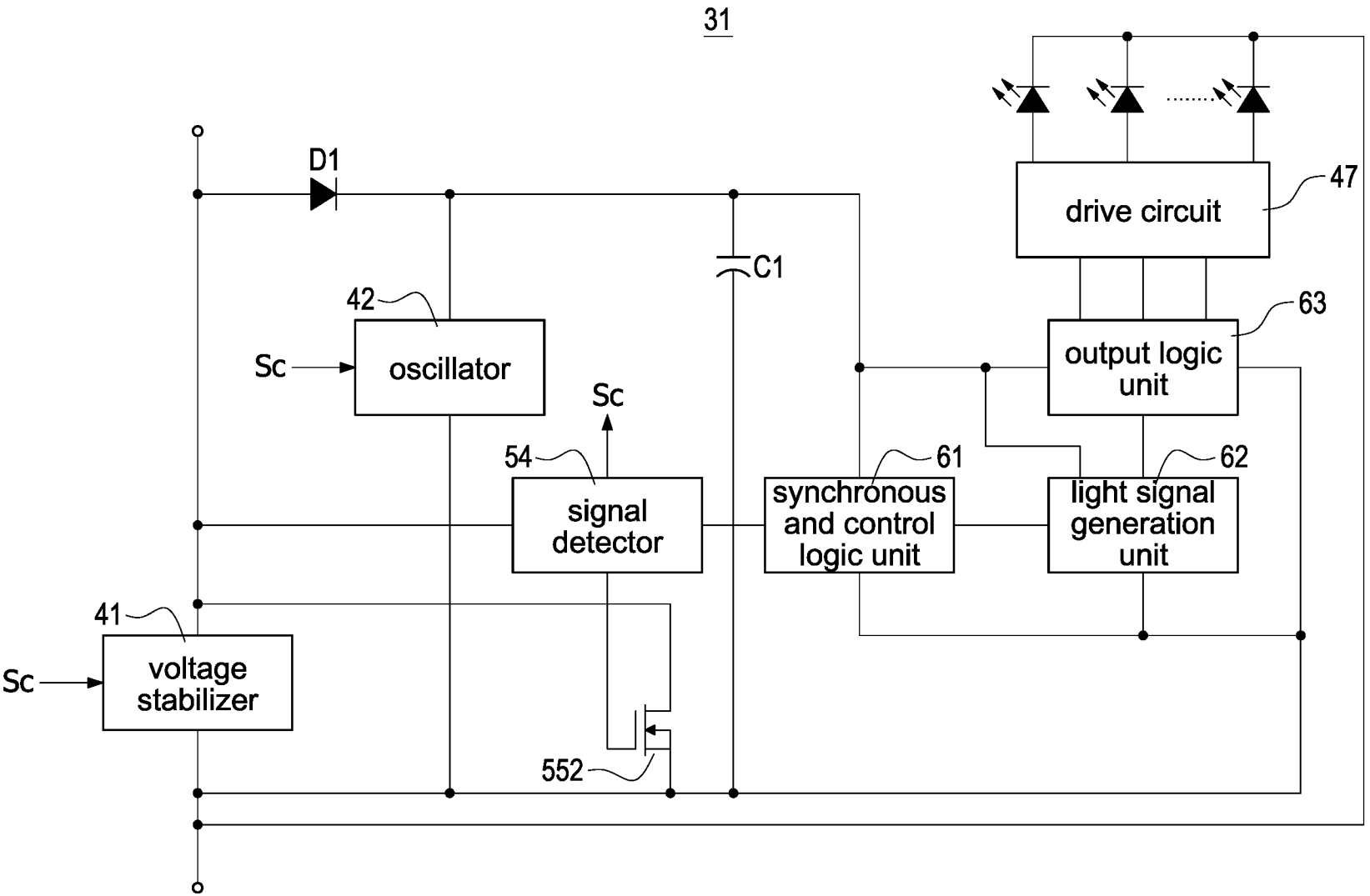

Please refer to FIG. 5B to FIG. 5D, which show block circuit diagrams of three specific circuits of the LED module according to the second embodiment of the present disclosure. In FIG. 5B, the fast discharge unit 55 is implemented by a resistor 551. Two ends of the resistor 551 are coupled to two ends of the voltage stabilizer 41, and the power consumption of the resistor 551 can reduce the voltage level of the light control signal. Specifically, when the resistance of the resistor 551 is larger, the voltage level decreases faster; on the contrary, when the resistance of the resistor 551 is smaller, the voltage level decreases slowly. Therefore, the effect of fast discharge can be achieved.

In FIG. 5C, the fast discharge unit 55 is implemented by a series-connected structure composed of a resistor 551 and a transistor 552 coupled in series to the resistor 551. Two ends of the series-connected structure are coupled at two ends of the voltage stabilizer 41, and a gate of the transistor 552 is coupled to the signal detector 54. Similarly, the signal detector 54 controls turning on the transistor 552 so that a turn-on resistance Rds(on) of the MOSFET is connected in series to the resistor 551 to reduce the voltage level of the light control signal, thereby implementing the fast discharge. Specifically, when the resistance of the resistor 551 is larger, the voltage level decreases faster; on the contrary, when the resistance of the resistor 551 is smaller, the voltage level decreases slowly. Similarly, when the turn-on resistance Rds(on) of the transistor 552 is larger, the voltage level decreases faster; on the contrary, when the turn-on resistance Rds(on) of the transistor 552 is smaller, the voltage level decreases slowly.

In FIG. 5D, the fast discharge unit 55 may be implemented by a transistor 552, for example but not limited to a metal-oxide-semiconductor field-effect transistor (MOSFET). Take the MOSFET as the transistor 552 as an example, a source and a drain of the MOSFET are coupled to two ends of the voltage stabilizer 41, and a gate of the MOSFET is coupled to the signal detector 54. The signal detector 54 controls turning on the transistor 552 so that the turn-on resistance Rds(on) to reduce the voltage level of the light control signal, thereby implementing the fast discharge.

In conclusion, the present disclosure has following features and advantages:

1. In the same architecture, the carry light signal and the power supplying source are both transmitted to the LED light string.

2. The fast discharging circuit inside each of the LED modules is provided to fast reduce the voltage level of the carry light signal to ensure that the complete discharge of the light control signal can be achieved to the identifiable low level voltage so as to ensure that all the number of LEDs connected in series (especially the string with more LEDs in series) can receive the complete light control signal.

3. The simple circuit components, such as resistors and transistors are used to implement the control and adjustment of fast discharging through the selection or design of resistance values of the circuit components.

4. It is to effectively reduce power consumption of the analogy circuits with relatively high power consumption and to make the LED module normally operate.

5. The LED module operates by the pixel control or by the synchronous control, and therefore to increase flexibility and convenience of designing the control circuit and implement diverse lighting effects and changes of the LED lamp.

6. The path composed of the first diode and the first capacitor is provided so that the energy stored in the first capacitor supplies the required power for internal circuits of the LED module when the DC power fails to be transmitted to the LED module, thereby maintaining the normal operation of the LED module without being affected by the reduced signal voltage.

Although the present disclosure has been described with reference to the preferred embodiment thereof, it will be understood that the present disclosure is not limited to the details thereof. Various substitutions and modifications have been suggested in the foregoing description, and others will occur to those of ordinary skill in the art. Therefore, all such substitutions and modifications are intended to be embraced within the scope of the present disclosure as defined in the appended claims.

What is claimed is:

1. A carry-signal controlled LED light with fast discharge, comprising:

at least one LED, and a drive unit coupled to the at least one LED, the drive unit configured to receive a carry light signal and control the at least one LED to light, the drive unit comprising:

a signal detector configured to receive the carry light signal and provide a discharge control signal according to the carry light signal, a fast discharge unit configured to receive the discharge control signal and control a voltage of the carry light signal to decrease faster, wherein the voltage of the carry light signal is lower than a low-level voltage by both turning on the fast discharge unit and providing a resistance from a positive power pin to a negative power pin of the fast discharge unit, a light control unit comprising:

an address and data identifier, a logic controller coupled to the address and data identifier, and a shift register coupled to the logic controller, the light control unit configured to drive the light behavior of the at least one LED according to light command content of the carry light signal, and a capacitor configured to receive a DC power source to be charged, and provide the required work power to the LED light when the fast discharge unit fast discharging.

2. The carry-signal controlled LED light with fast discharge in claim 1, further comprising:

a voltage clamp unit coupled to the fast discharge unit, and configured to clamp the voltage of the carry light signal to be greater than a reset voltage when the voltage of the carry light signal being less than the low-level voltage.

3. The carry-signal controlled LED light with fast discharge in claim 1, wherein the fast discharge unit is a series-connected structure composed of a resistor and a transistor.

4. The carry-signal controlled LED light with fast discharge in claim 3, wherein a resistance of the resistor is larger, the voltage of the carry light signal decreases faster.

5. The carry-signal controlled LED light with fast discharge in claim 3, wherein a turned-on resistance of the transistor is larger, the voltage of the carry light signal decreases faster.

6. The carry-signal controlled LED light with fast discharge in claim 3, wherein the transistor is a metal-oxide-semiconductor field-effect transistor.

7. The carry-signal controlled LED light with fast discharge in claim 1, wherein the signal detector is configured to generate a control signal for turning off analogy circuits in the LED light.

8. The carry-signal controlled LED light with fast discharge in claim 1, wherein the LED lamp is controlled by a pixel control manner or a synchronous control manner.

9. A carry-signal controlled LED light string, comprising:

a power line, a controller coupled to the power line, and at least one LED light, each LED light comprising:

at least one LED, and a drive unit coupled to the at least one LED, the drive unit configured to receive a carry light signal and control the at least one LED to light, the drive unit comprising:

a signal detector configured to receive the carry light signal and provide a discharge control signal according to the carry light signal, a fast discharge unit configured to receive the discharge control signal and control a voltage of the carry light signal to decrease faster, wherein the voltage of the carry light signal is lower than a low-level voltage by both turning on the fast discharge unit and providing a resistance from a positive power pin to a negative power pin of the fast discharge unit, a light control unit comprising:

an address and data identifier, a logic controller coupled to the address and data identifier, and a shift register coupled to the logic controller, the light control unit configured to drive the light behavior of the at least one LED according to light command content of the carry light signal, and a capacitor configured to receive a DC power source to be charged, and provide the required work power to the LED light when the fast discharge unit fast discharging, wherein the at least one LED light is coupled to the controller through the power line, and is configured to receive a DC working power and the carry light signal transmitted from the controller through the power line.

10. The carry-signal controlled LED light string in claim 9, wherein the controller comprises:

a rectifier unit coupled to the power line and configured to provide the DC working power, a switch coupled to the power line and the at least one LED light, and a control unit coupled to the rectifier unit and the switch, wherein when the control unit is configured to turn on the switch, the DC working power forms a power supply loop for the LED light through the power line, wherein when the control unit is configured to produce the carry light signal, the control unit is configured to continuously turn on and turn off the switch according to the light command content of the carry light signal so that the DC working power of the power line forms a plurality of pulse waves to be combined into the carry light signal, and transmit the carry light signal to the LED light through the power line.

11. The carry-signal controlled LED light string in claim 9, wherein the controller further comprises:

a discharge circuit coupled to the power line and the control unit, wherein when the switch is turned off, the controller is configured to drive the discharge circuit to receive the DC working power and to start discharging the DC working power.

12. The carry-signal controlled LED light string in claim 9, wherein the controller further comprises:

a voltage adjust capacitor coupled to the power line, wherein when the switch is turned off, the voltage adjust capacitor is configure to provide the DC working power to the at least one LED light.

13. A carry-signal controlled LED light with fast discharge, comprising:

at least one LED, and a drive unit coupled to the at least one LED, the drive unit configured to receive a carry light signal and control the at least one LED to light, the drive unit comprising:

a signal detector configured to receive the carry light signal and provide a discharge control signal according to the carry light signal, a fast discharge unit configured to receive the discharge control signal and control a voltage of the carry light signal to decrease faster, wherein the voltage of the carry light signal is lower than a low-level voltage by providing a resistance from a positive power pin to a negative power pin of the fast discharge unit, a light control unit comprising:

an address and data identifier, a logic controller coupled to the address and data identifier, and a shift register coupled to the logic controller, the light control unit configured to drive the light behavior of the at least one LED according to light command content of the carry light signal, and a capacitor configured to receive a DC power source to be charged, and provide the required work power to the LED light when the fast discharge unit fast discharging.

14. The carry-signal controlled LED light with fast discharge in claim 13, further comprising:

a voltage clamp unit coupled to the fast discharge unit, and configured to clamp the voltage of the carry light signal to be greater than a reset voltage when the voltage of the carry light signal being less than the low-level voltage.

15. The carry-signal controlled LED light with fast discharge in claim 13, wherein the fast discharge unit is a resistor.

16. The carry-signal controlled LED light with fast discharge in claim 15, wherein a resistance of the resistor is larger, the voltage of the carry light signal decreases faster.

17. The carry-signal controlled LED light with fast discharge in claim 13, wherein the signal detector is configured to generate a control signal for turning off analogy circuits in the LED light.

18. The carry-signal controlled LED light with fast discharge in claim 13, wherein the LED lamp is controlled by a pixel control manner or a synchronous control manner.

* * * * *